US005223908A

United States Patent [19]

Scott et al.

[11] Patent Number: 5,223,908

[45] Date of Patent: Jun. 29, 1993

[54] MEASUREMENT OF BLAST FURNACE RACEWAY PARAMETERS

[75] Inventors: John C. Scott, Merewhether; Stuart A. Fysh, Olinda; Peter H. Scaife, Charlestown, all of Australia

[73] Assignee: The Broken Hill Proprietary Company, Melbourne, Australia

[21] Appl. No.: 555,389

[22] PCT Filed: Feb. 3, 1989

[86] PCT No.: PCT/AU89/00041

§ 371 Date: Feb. 21, 1991

§ 102(e) Date: Feb. 21, 1991

[87] PCT Pub. No.: WO89/07156

PCT Pub. Date: Aug. 10, 1989

[30] Foreign Application Priority Data

Feb. 3, 1988 [AU] Australia ..... PI6556/88

[51] Int. Cl.[5] ..... G01C 3/08; G01B 11/06

[52] U.S. Cl. ..... 356/5; 356/381

[58] Field of Search ..... 356/5, 381

[56] References Cited

U.S. PATENT DOCUMENTS

| | | | |
|---|---|---|---|
| 3,752,581 | 8/1973 | Everest et al. | 356/5 |
| 4,159,873 | 7/1979 | Farnsworth | 356/5 |
| 4,172,661 | 10/1979 | Marcus et al. | 356/5 |
| 4,508,448 | 4/1985 | Scholdstrom et al. | 356/5 |

OTHER PUBLICATIONS

Japanese Patent Abstract of 53 48 001 dated Jul. 26, 1978.

Japanese Patent Abstract of 59 232 203 dated May 8, 1985.

Japanese Patent Abstract of 60 77 911 dated Aug. 29, 1985.

Japanese Patent Abstract of 60 165 310 dated Jan. 9, 1986.

Japanese Patent Abstract of 60 187 608 dated Feb. 13, 1986.

Japanese Patent Abstract of 61 44 113 dated Jul. 16, 1986.

Japanese Patent Abstract of 61 48 508 dated Jul. 22, 1986.

Japanese Patent Abstract of 53 106 307 dated Nov. 18, 1978.

Japanese Patent Abstract of 59 9114 dated Apr. 27, 1984.

Japanese Patent Abstract of 55 41 904 dated Jun. 4, 1980.

Japanese Patent Abstract of 58 55 512 dated Jun. 22, 1983.

Japanese Patent Abstract of 59 9113 dated Apr. 27, 1984.

*Primary Examiner*—Stephen C. Buczinski

*Attorney, Agent, or Firm*—Nikaido, Marmelstein, Murray & Oram

[57] ABSTRACT

A blast furnace with a blowpipe (12) opening through the furnace wall (11) has apparatus for analysis (20) in a raceway (18) adjacent the blowpipe opening in a bed of the blast furnace. The apparatus includes means (24) arranged in relation to the blast furnace to transmit an optical signal into the raceway and means (30) for monitoring a received signal derived from reflection or scattering of the transmitted optical signal in the raceway. Means (32) is provided to analyse the received signal in relation to the transmitter signal and to thereby obtain a measure of a parameter of the raceway. The method of analysis comprises transmitting an optical signal into the raceway, monitoring a received signal derived from reflection or scattering of the transmitted optical signal in the raceway, and analyzing the received signal in relation to the transmitted signal to obtain a measure of a parameter of the raceway.

6 Claims, 5 Drawing Sheets

MEASUREMENT OF BLAST FURNACE RACEWAY PARAMETERS

BACKGROUND OF THE INVENTION

This invention relates to the measurement of blast furnace raceway parameters such as raceway depth, brightness and/or temperature.

A raceway is the space immediately behind a tuyere of an ironmaking blast furnace, where a rotating flow of coke particles and gas is formed by the hot blast emerging from the tuyere. The temperature in the raceway zone is typically about 2000° C. A number of raceways are evenly distributed around the furnace circumference, and their function is to generate and distribute hot reducing gases to the furnace burden. Stable furnace operation requires confinement of this hot, reducing gas flow to the furnace centre to prevent refractory damage and maintain stable burden descent.

Raceway depth and shape are fundamental determinants of gas and heat flow distributions in the packed bed of a blast furnace, thus exerting considerable influence on furnace operation and efficiency. Widespread availability of raceway depth sensing could be expected to have a significant impact by enhancing fundamental understanding of the processes occurring in the furnace combustion zone. From an operational standpoint, raceway depth measurement could be expected to contribute in the following areas:

- control of peripheral uniformity of gas and heat flow
- in-situ assessment of the effects of variations in coke quality in the furnace high temperature zone
- control of hot metal silicon through optimization of the position of the cohesive zone
- optimization of casting practice via internal sensing of internal liquid levels.

With reference to the second of these areas, it has been theoretically shown that raceway depth is a function of the coke mean size at the tuyere, and should therefore give a good indication of the coke quality in the high temperature zone. This relationship has been verified on both hot models an operating furnaces, but it is apparent that there is considerable disagreement as to the exact form of the correlation and significant scatter between the results obtained when measurements are made on a number of blast furnaces It seems likely that differences in raceway depth measurement methods contribute to this confusion , particularly considering the effect on the raceway of the invasive measurement methods employed to date.

Previous measurements of raceway depth have relied on the introduction of a water-cooled metal probe t tuyere. In these measurements, the raceway wall is assumed to have been reached when a predetermined wall pressure is observed or the probe stops moving While a single measurement can take less than a minute to make, repeated measurements are difficult and dangerous. Also the technique suffers from a number of other disadvantages:

(a) It is invasive and may interfere with the dynamics of the raceway, thus causing a change in the very parameter it is meant to measure.

(b) Flexing of the probe in the raceway introduces uncertainties in the measurements.

(c) Repeated measurements on a routine basis are not practical After each measurement, the probe must either be retracted into the blow pipe or completely removed for cooling before another measurement can be made.

(d) The technique cannot be used for making multiplexed depth measurements on a number of raceways For each raceway a completely separate measuring system must be used.

More recently, theoretical predictions of the relationship between raceway depth and additional operational variables such as cohesive zone location and hearth drainage parameters have been made. Such modelling has the potential to greatly improve understanding but again it seems likely that raceway depth measurement technology which is adaptable to an operational mode must be developed if this benefit is to be secured. This then is the object of the present invention.

SUMMARY OF THE INVENTION

The invention essentially entails an appreciation that optical techniques may be successfully employed for raceway depth measurement, and the unexpected finding that such techniques can be used to meaningfully measure other raceway parameters. A prima facie consideration would suggest that optical techniques would not be successful in the hostile environment of a blast furnace raceway, especially in view of the continuing presence of a cloud of coke particles moving at relatively high speeds.

The invention accordingly affords a method of analysis in a raceway in the bed of blast furnace, comprising transmitting an optical signal into the raceway, monitoring a received signal derived from reflection or scattering of the transmitted optical signal in said raceway, and analyzing the received signal in relation to the transmitted signal to obtain a measure of a parameter of the raceway.

The invention more particularly provides a method of measuring a raceway in the bed of a blast furnace, comprising transmitting an optical signal, preferably of laser light, down the blowpipe , and thereby through the associated opening in the furnace wall into the raceway, monitoring a received signal including at least a portion of the signal reflected by the bed interface bounding the raceway, and analyzing the received signal in relation to the transmitted signal to determine the location of the reflecting interface.

The analysis of the received signal preferably comprises a time-of-flight analysis relying upon the time elapsed between transmission of the initial signal and receipt of an identifiable segment of the received signal. This received signal is preferably a portion of said reflected signal returned back along the blowpipe. An alternative to time-of-flight analysis is a triangulation technique.

The invention also provides, in a blast furnace having a blowpipe opening through the furnace wall, apparatus for analysis in a raceway adjacent the blowpipe opening in a bed of the blast furnace, comprising means arranged in relation to the blast furnace to transmit an optical signal into the raceway, means for monitoring a received signal derived from reflection or scattering of the transmitted optical signal in the raceway, and means to analyse the received signal in relation to the transmitted signal and to thereby obtain a measure of a parameter of the raceway.

The signal transmission means and signal analysing means may be arranged so that at least a portion of the transmitted optical signal is reflected by the bed interface bounding the raceway, whereby the analysis obtains a measure of the location of the reflecting interface.

The apparatus preferably includes a suitable window assembly in the blowpipe through which the transmitted and received signals pass.

Most advantageously, the transmitted optical signal is a sequence of pulses and the received signal a further sequence of pulses, and the or each reflection arising from each transmitted pulse is identifiable whereby the depth of the raceway is determinable from the reflected pulse observed to be arising from the furthest point in the raceway. Preferably, the principal return reflections of multiple transmitted pulses are detected and the frequencies of reflections compared for different distances indicated by the received reflections, the raceway depth being determined from the furthest of said distances when the frequency of reflections at said furthest distance is greater than for distances immediately closer: the transmitted pulses are preferably arranged to facilitate the latter outcome, for example by being in a beam of cross-section substantially smaller than the average size of coke particles in the raceway.

BRIEF DESCRIPTION OF THE DRAWINGS

The invention will now be further described, by way of example only, with reference to the accompanying drawings, in which.

DETAILED DESCRIPTION OF A PREFERRED EMBODIMENT

Figure 1:
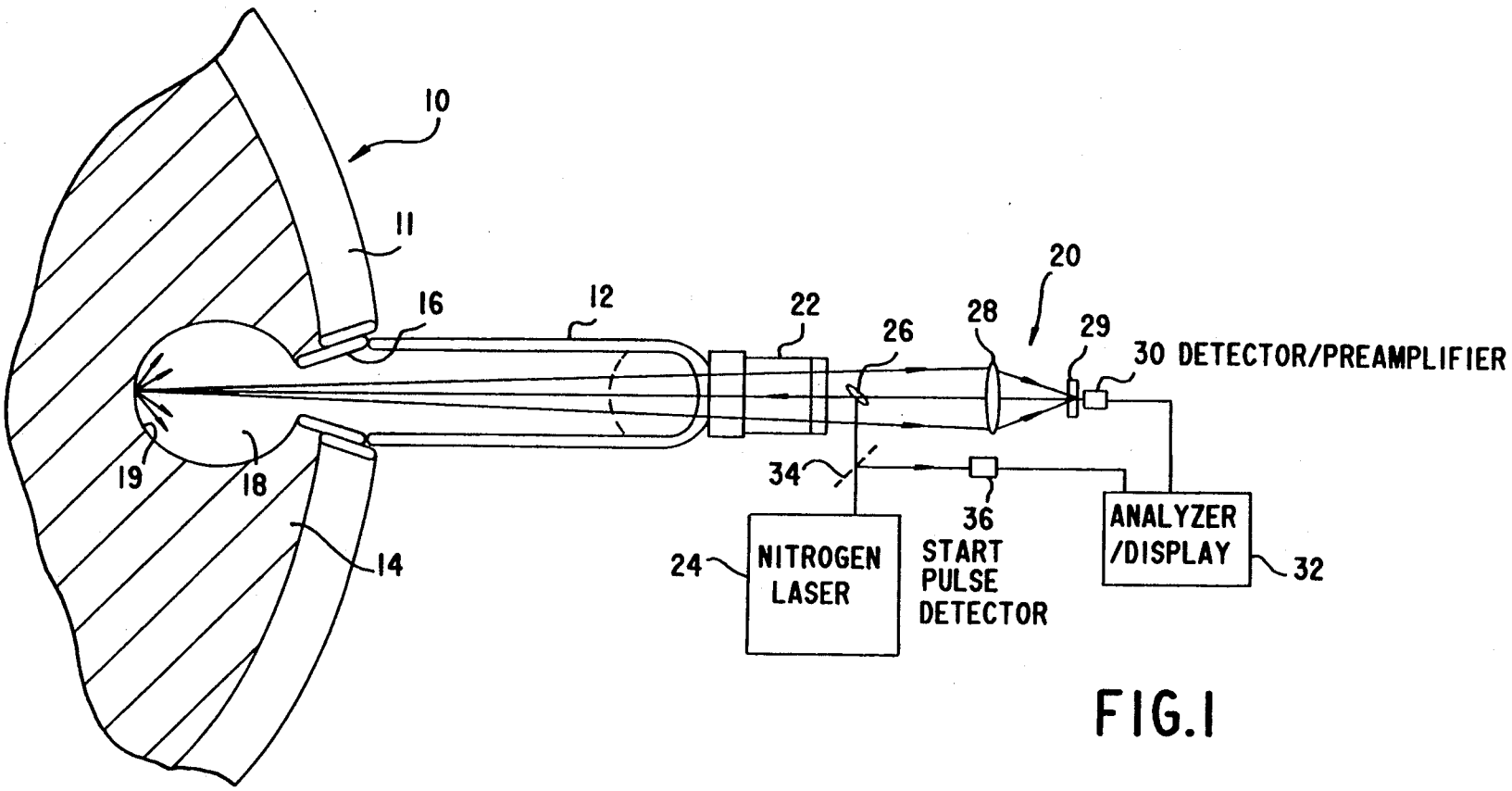
FIG. 1 is a schematic representation of raceway measuring apparatus according to the invention, shown in operative association with the blowpipe of a blast furnace.

The arrangment of FIG. 1 includes a blast furnace 10 having a refractory wall 11 and fitted with a blowpipe 12. The latter is a conduit for jetting oxygen and other gases into the bed 14 in the furnace and opens through furnace wall 11 at a water-cooled tuyere 16. A raceway 18 forms in the bed adjacent the tuyere and blowpipe 12 carries apparatus 20 for measuring this raceway, especially its depth, for the purposes discussed above.

Apparatus 20 includes a sealed silica window assembly 22 which is fitted at a bend in the blowpipe and constitutes the access port for light to be utilised in measuring the depth of the raceway. The source or transmitter of this light comprises a nitrogen laser 24 of operating wavelength 337.1 nm, whose beam is directed coaxially down the blowpipe by a mirror 26. A portion of the light reflected at the interface 19 bounding the raceway is focussed by a lens 28 through a narrow bandpass filter 29 to a detector/ preamplifier 30. Filter 29 is a 10 nm bandpass filter centered on 337.1 nm to exclude from the detector's field of view background radiation outside the laser's emission wavelength. The output of the preamplifier, a direct electrical representation of the received optical signal, is directed to a suitable analyser and/or display 32, which is also responsive by means of a start pulse detector 36 to a segment of the transmitted signal deflected by a beamsplitter 34. Analyser/display 32 provides an indication of the time delay between the transmitted and received signals so that the depth of raceway 18 can be determined by time-of-flight analysis.

Figure 1A:
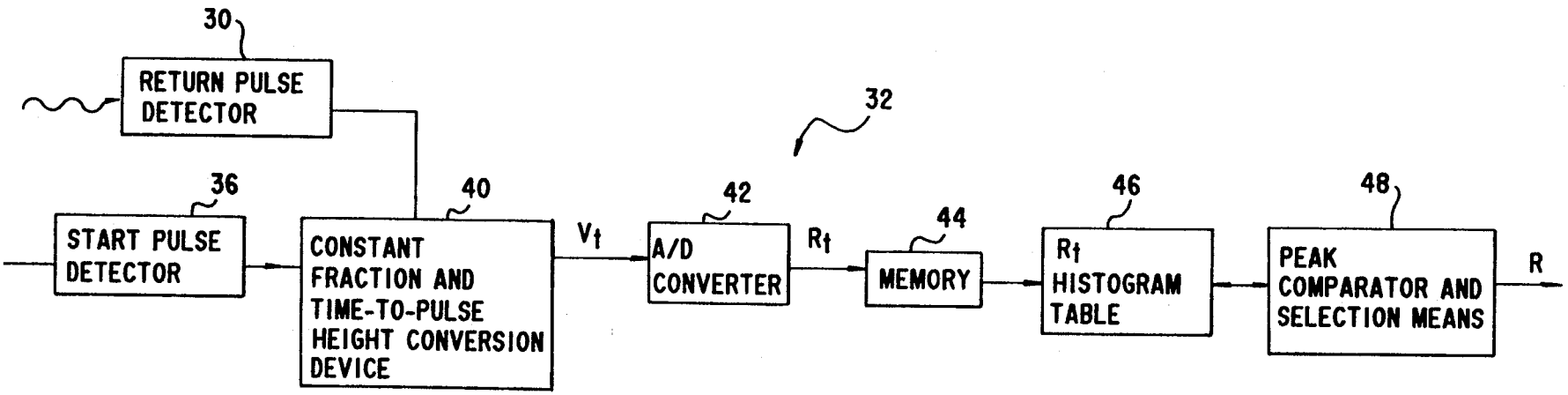
FIG. 1A is a more detailed block diagram which includes the principal elements of the analyzer 32 of FIG. 1.

Analyser 32 is preferably an analogue processor. The start and return pulses are processed (FIG. 1A) by this processor using constant fraction discrimination and time-to-pulse height conversion 40 to produce a 20 $\mu$s voltage pulse $V_t$ whose amplitude is proportional to the time of flight of the laser pulse. For each transmitted laser pulse, the amplitude of the voltage pulse is acquired using a fast A/D converter 42 and employed to determine the target range $R_t$(i.e. the distance to the reflection), measured from the end of the tuyere, which is then stored in a memory 44. Each range measurement is time stamped to allow subsequent correlation with other furnace parameters.

The mentioned nitrogen laser is the preferred source, in view of a number of considerations. A major requirement for time-of-flight ranging in the raceway is a suitably short pulse length—the pulse length needs to be shorter than or comparable with the separation of coke particles in the raceway to give a reasonable chance of resolving radiation reflected by these particles from that reflected from the back wall of the raceway. A pulse length of less than 1 ns (equivalent to a 300 mm long pulse of light) is capable of resolving targets separated by about 150 mm, and should be suitable Such short pulses are best obtained from laser sources, and use of a laser is also consistent with the spatial collimation necessary to give the required field of view, which is defined by the opening at tuyere 16 and is typically less than 30 mr.

Besides the ability to produce short pulses, the other principal consideration in selecting a source is its wavelength. The raceway back wall is a very bright source against which reflected laser radiation must be viewed, so that some degree of spectral discrimination will be required. The spectral radiance of black bodies at temperatures in the vicinity of that of the raceway (around 2000°) peak in the visible to very near infrared. Considering the emission wavelengths of various lasers, the short pulse length requirement and the desirability of employing a long lived laser based on well established technology, the nitrogen laser emerges as a favoured choice. A typical nitrogen laser is also characterised by a pulse length of 0.3 nsec, pulse power of 250 kW, and a repetition rate of 20 Hz.

Figure 2:
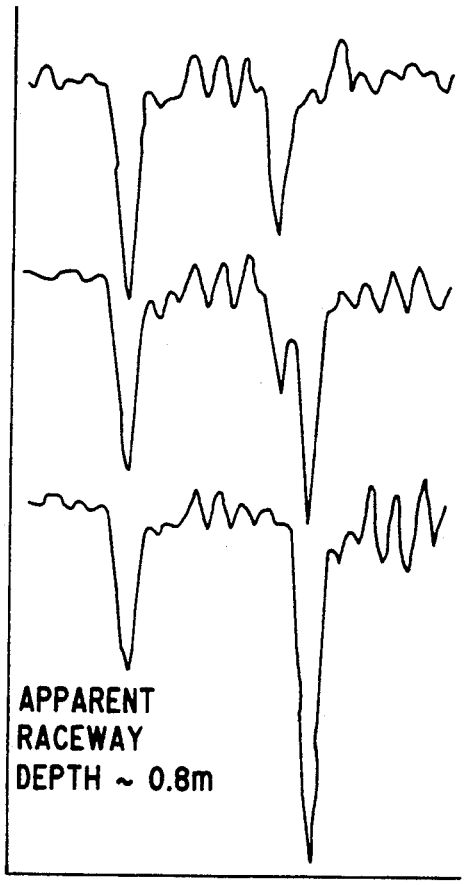
FIG. 2 depicts three successive detected return pulses derived during use of the apparatus of FIG. 1 to measure the depth of the raceway in a particular blast furnace.

FIG. 2 depicts a simple output signal for successive measurements conducted on a working blast furnace with single incident laser pulses. The left peak is due to coke right at the tuyere nose and the right peak is considered to be for the rear interface of the raceway: the apparent raceway depth on a time-of-flight basis is about 0.8 m, which is in line with expected values for this furnace.

It will be seen that it is desirable to be able to identify each reflection of a pulse so that, for a sequence of transmitted pulses, the pulse observed to be reflected from a point furthest in the raceway is identifiable and determines the raceway, (i.e., the raceway depth). Commercial distance measuring devices typically cannot be applied to raceway depth measurement because they average results over a sequence of reflected pulses in order to minimise the effect of noise. This averaging eliminates the information provided by each individual reflected pulse—and it is the information present in an occasional individual reflected pulse which indicates the depth of a raceway.

Figure 3A:
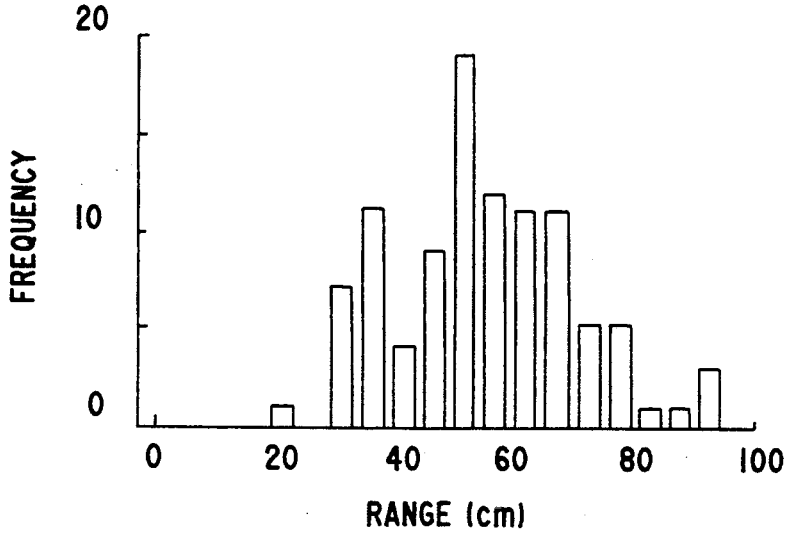
FIG. 3A and 3B are histograms of the frequency of detected reflections for different distances indicated by the reflections, respectively for transmitted beam cross-section/coke particle size ratios of 1:8 and 1:1.
Figure 3B:
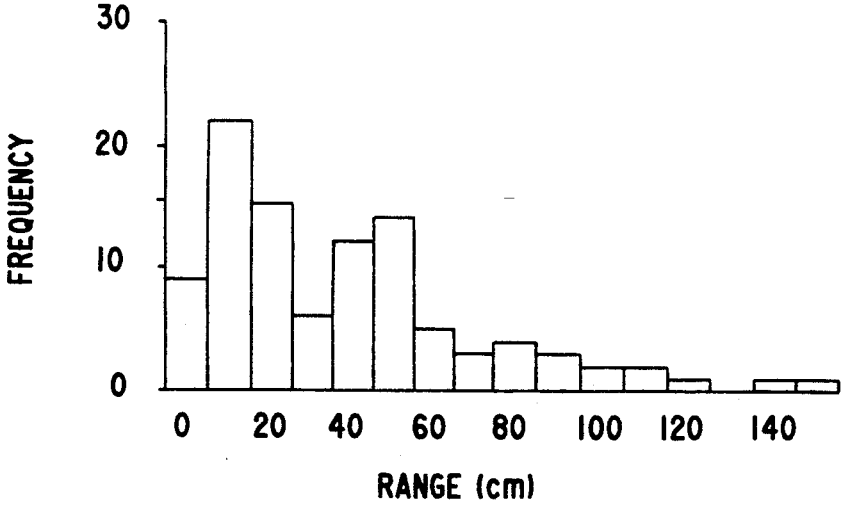

It is preferable to carry out multiple measurements in order to identify and ignore reflections from pieces of coke right in the line of sight in front of the raceway wall, had to establish that the last reflection has indeed returned from the raceway wall. One approach is to produce a histogram plot of ranges measured over a short time interval (i.e., number of reflected return pulses giving a distance value within each of a sequence of short sets of values) in a device 46 (FIG. 1A) coupled to scan the stored values of $R_1$ in the memory 44. The peak comparator and selection means 48 compares frequency peaks indicative of frequencies of occurrence of return pulses for different distances derived therefrom and selects a furthest distance as the raceway depth based on the frequency of occurrence of that distance being greater than that for closer distances. That furthest distance represented as a peak at the right hand limit of the plot then confirms that this furthest distance is very likely the raceway wall. If the frequency of reflections distances immediately closer, one cannot at all disregard the possibility that the right hand limit of the histogram plot is a particle of coke. FIG. 3B demonstrates such a situation: it is modelled for similar beam cross-section and particle size and also suggests, by comparison with FIG. 3A, that the beam cross-sections should be substantially smaller than the average size of coke particles in the raceway It has been found that the range is smoothened considerably in going from 10 to 50 pulses but only marginally from 50 to 100 pulses, thus suggesting that 100 pulses, perhaps only 50 to 100 pulses, are sufficient for removal of the fast range fluctuations arising from laser beam scattering off fast moving coke particles. An increase beyond 100 pulses may not produce very much additional information and may in some cases result in smoothening of wanted raceway depth variations.

Alternatively, in order to satisfactorily resolve the raceway interface from the circulating coke, detector/-preamplifier 32 will need to have a bandwidth of the order of 700 MHz.

Figure 4:
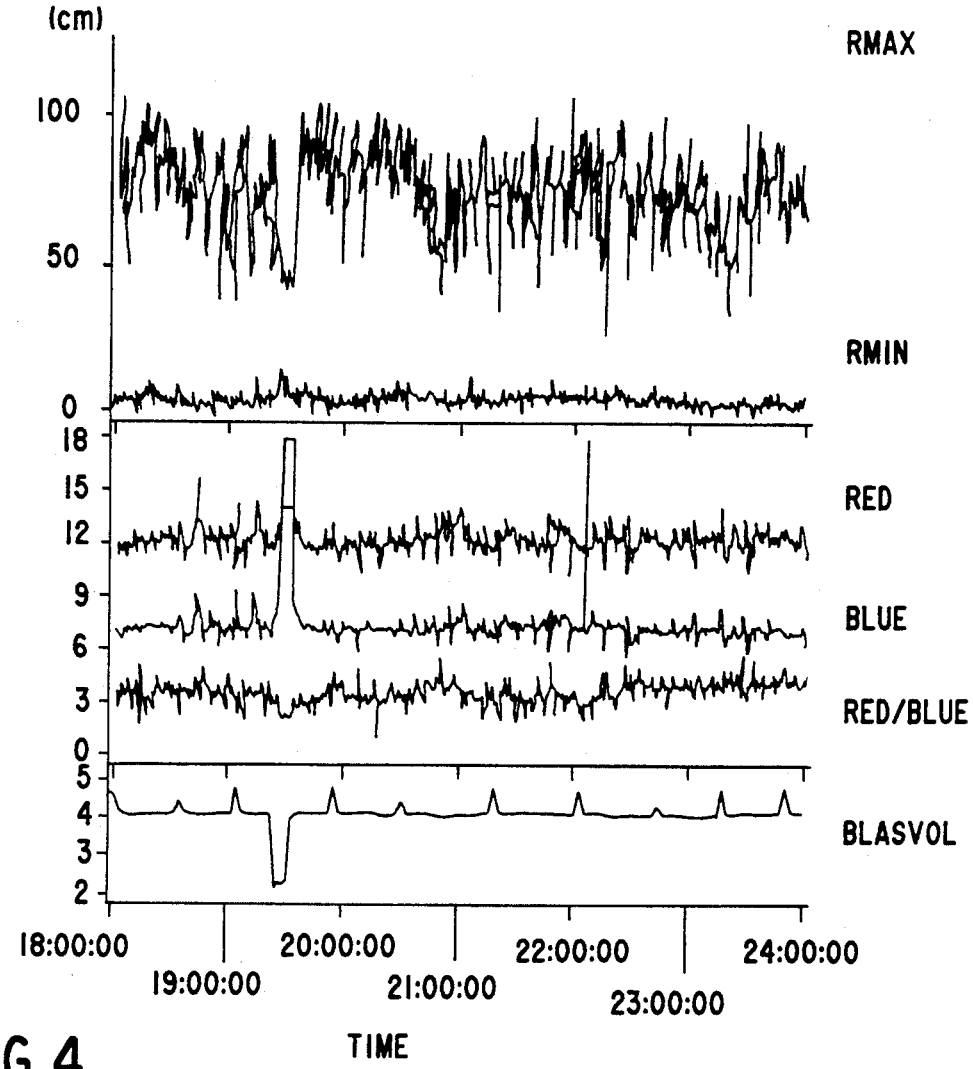
FIG. 4 shows selected detected signals over an extended period of time during use of the apparatus of FIG. 1.

FIG. 4 shows typical sets of return data produced for multiple pulses over a particular period of time. It has been found that these curves can be employed to determine other raceway parameters In FIG. 4, the top curve is the maximum range encountered (already discussed), the second curve is the minimum range, the third and fourth are red and blue brightness respectively, the fifth is effectively the raceway temperature and the bottom is the blast volume. The raceway depth plot shows the period of time lasting from several tens of seconds to minutes where the depth reduces to a value less than half that of the average for that period. Analysis of video images taken at the same time reveal that these are the result of pieces of the cohesive zone or skull falling into the raceway zone, the depth recovering as the material is gradually blown away by the blast. If the number of these events is plotted as a function of time, it is thought that the rate of occurrence of these events is a measure of the proximity of the cohesive zone.

In general, assuming that the back wall does not move significantly over the time-scale of a single depth measurement, the frequency of pulse penetration to the wall should increase as the ratio of beam to particle size decreases. To test this, a simple two-dimensional model of a raceway was set-up and the effects of changing the laser beam size on the statistics of laser returns was investigated. The model was also used to investigate the feasibility of determining coke size in the raceway zone by comparing the statistical distribution of returns from alternate depth measurements made using laser beam sizes which were small and large compared to the mean coke size.

Figure 5:
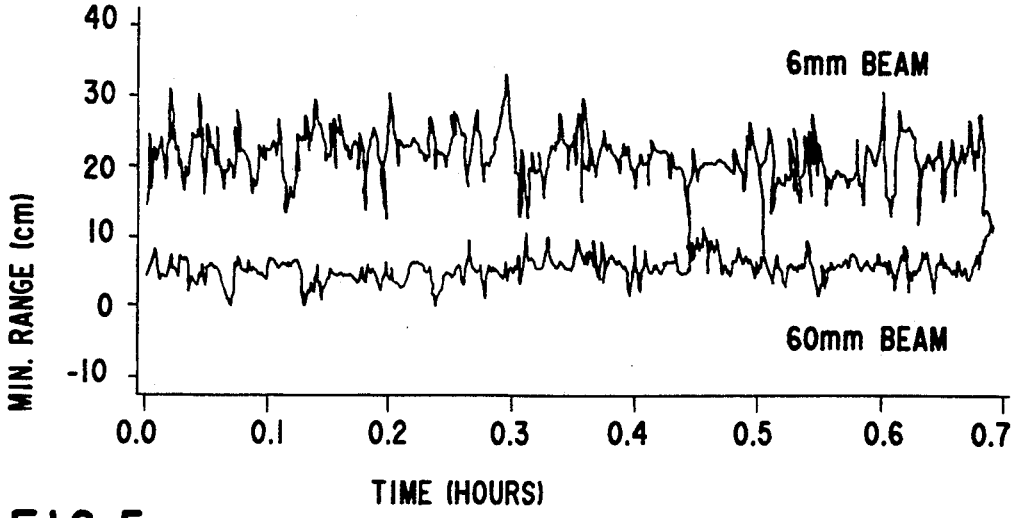
FIG. 5 is a plot of minimum range—that is, the distance indicated by the earliest reflections—over a period of time, for respective beam cross-sections of 6 mm and 60 mm.

The model consisted of a two dimensional space within which a random distribution of identical spherical coke particles was generated. Velocity measurements made from high speed films (5000 frame/s) of the raceway have shown that the transverse velocity of coke particles lies within the range form 0.5 to 12 m/s. For a 1.2 m deep raceway, which is the maximum depth measured so far, the maximum transit time through the raceway is roughly 8 nanoseconds. This is equivalent to coke movement of 0.1 micron. Consequently raceway coke particles are essentially frozen during a single pulse measurement It is thought that as the blast leaves the tuyere and enters the raceway a particular blast volume distribution is produced. This results in small particles being swept well into the raceway before they reach the tuyere centreline whereas large particles will penetrate the blast vertically before they move far into the raceway. This implies that if the laser beam is large it will strike both large and small coke very close to the tuyere nose and for a small laser beam the small coke will be struck later in the raceway than the large coke. In fact for a small diameter laser beam the minimum range at which the coke is encountered may be interpreted as a measure of the coke size after taking into account other factors such as blast volume, etc. FIG. 5 shows a comparison of the minimum coke distance for 3BF RBPD using a) 60 mm beam cross-section size and b) 6 mm beam cross-section size. The difference in range is attributed to the coke trajectory described above and hence a relative measure of mean coke size. The occasional short range for the small beam size will be noted indicating the possibility of the occasional large piece of coke entering the raceway. When the wind volume flow rates are taken into account the system is expected to produce real time continuous measurement of coke size in the raceway.

FIG. 1 depicts only a measuring unit attached to a single blowpipe, but in practice it is preferable to multiplex a single measuring unit, comprising source laser, detector/preamplifier, analyser/display and associated optics, to a number of tuyeres. This is most suitably achieved via an optical fibre network. Apart from cost and efficiency savings, there would also be advantages in removing the instrumentation from the immediate environment of the blast furnace The above-described raceway depth probe arrangement is successfully non-invasive and is capable of operating over the typical distances involved, of the order of 5 m, with an accuracy of about ±50 mm, with a measurement available at least once a minute. The time scale for making a single raceway depth measurement is about 10 seconds using a pulse repetition frequency of 10 Hz. It can handle the small field of view—less than 30 mr—and can function in an environment entailing high pressures, velocities and temperature gas blast. It can operate in a raceway which includes flames from combustion of injected fuels and a significant quantity of circulating coke, against a background temperature of around 2500° C. provided by the coke target.

We claim:

1. In a blast furnace having a blowpipe opening through the furnace wall, an apparatus for analysis in a raceway adjacent the blowpipe opening in a bed of the blast furnace, including determination of the raceway depth, comprising:

signal transmission means arranged in relation to the blast furnace for transmitting an optical signal that includes a sequence of transmitted pulses;

monitoring means for monitoring a received signal derived from reflection or scattering of the transmitted optical signal in the raceway, the received signal including a sequence of return pulses, said monitor means further including means for detecting each of the sequence of return pulses arising from the reflection or scattering of each of the sequence of transmitted pulses; and analyzing means for analyzing the received signal in relation to the transmitted optical signal, said analyzing means further including means for comparing a frequency of occurrence of the return pulses for different distances indicated by the received return pulses and selecting means for selecting a furthest distance from the different distances as a raceway depth based on the frequency of occurrence of the furthest distance being greater than that for closer distances.

2. An apparatus according to claim 1 further including a window assembly in the blowpipe through which the transmitted and received signals pass.

3. An apparatus according to claim 1 wherein the transmitted optical signal is a sequence of pulses and the received signal a further sequence of pulses, such that each transmitted pulse reflecting in the raceway generates a reflected pulse that is identifiable whereby a depth of the raceway is determinable from a reflected pulse observed to be arising from a furthest point in the raceway.

4. A method of analysis in a raceway adjacent the blowpipe opening in a bed of a blast furnace, including determination of the raceway depth, the method comprising the steps of:

transmitting an optical signal into the raceway, the optical signal including a sequence of transmitted pulses;

monitoring a received signal derived from reflection or scattering of the transmitted optical signal in the raceway, the received signal including a sequence of return pulses, said step of monitoring the received signal further including the step of detecting each of the sequence of return pulses arising from reflection or scattering of each of the sequence of transmitted pulses; and analyzing the received signal in relation to the transmitted optical signal, said step of analyzing the received signal further including the steps of comparing a frequency of occurrence of the return pulses for different distances indicated by the received return pulses and selecting a furthest distance from the different distances as a raceway depth based on the frequency of occurrence of the furthest distance being greater than that for closer distances.

5. A method according to claim 4 wherein the transmitted optical signal is reflected by a bed interface bounding raceway, whereby said step of analyzing the received signal further includes the step of obtaining a measure of the location of the reflecting bed interface.

6. A method according to claim 4 or 5 wherein the transmitted and received signals pass through a window assembly to and from a blowpipe associated with the raceway.

* * * * *